US010925459B2

(12) United States Patent
Shin

(10) Patent No.: US 10,925,459 B2
(45) Date of Patent: Feb. 23, 2021

(54) CASE FOR DISHWASHER-USE WASHING BALLS

(71) Applicant: DAEEUN GLOBAL SOLUTION CO., LTD., Incheon (KR)

(72) Inventor: Kyung-sub Shin, Inchcon (KR)

(73) Assignee: DAEEUN GLOBAL SOLUTION CO., LTD., Incheon (KR)

( * ) Notice: Subject to any disclaimer, the term of this patent is extended or adjusted under 35 U.S.C. 154(b) by 632 days.

(21) Appl. No.: 14/909,664

(22) PCT Filed: Oct. 29, 2013

(86) PCT No.: PCT/KR2013/009651

§ 371 (c)(1),
(2) Date: Feb. 2, 2016

(87) PCT Pub. No.: WO2015/020268

PCT Pub. Date: Feb. 12, 2015

(65) Prior Publication Data

US 2016/0183761 A1 Jun. 30, 2016

(30) Foreign Application Priority Data

Aug. 5, 2013 (KR) ..... 10-2013-0092525

(51) Int. Cl.
*A47L 15/42* (2006.01)

(52) U.S. Cl.
CPC ..... *A47L 15/42* (2013.01); *A47L 2601/18* (2013.01)

(58) Field of Classification Search
None
See application file for complete search history.

(56) References Cited

U.S. PATENT DOCUMENTS 5,768,917 A * 6/1998 Freida ..... D06F 39/024 206/0.5
6,032,495 A 3/2000 Leu
7,422,759 B2 * 9/2008 Kepner ..... A01N 25/12 424/617
2010/0281928 A1 11/2010 Martin

FOREIGN PATENT DOCUMENTS

KR 20-0140186 Y1 5/1999
KR 10-2005-0012752 A 2/2005
KR 10-1053085 B1 8/2011
KR 20-0458539 Y1 2/2012
KR 30-0633762 S 3/2012

OTHER PUBLICATIONS

Eric Savitz, CES: Super Wash Ball!, Jan. 18, 2012, pp. 1-2 (Year: 2012).*

* cited by examiner

*Primary Examiner* — Rita P Adhlakha
(74) *Attorney, Agent, or Firm* — IP Legal Services, LLC

(57) ABSTRACT

The present invention relates to a washing ball case for a dishwasher. The washing ball contains a case body with an upper plate portion and a lower plate portion and has through holes formed in an outer side portion thereof so as to completely drain the washing water at the time of washing dishes.

4 Claims, 4 Drawing Sheets

CASE FOR DISHWASHER-USE WASHING BALLS

CROSS REFERENCE TO RELATED APPLICATIONS

This application is a National Stage Patent Application of PCT International Patent Application No. PCT/KR2013/009561 (filed on Oct. 29, 2013) under 35 U.S.C. § 371, which claims priority to Korean Patent Application No. 10-2013-0092525 (filed on Aug. 5, 2013), the teachings of which are incorporated herein in their entireties by reference.

BACKGROUND OF THE INVENTION

Field of the Invention

The present invention relates to a washing ball case for a dishwasher, used to wash dishes (plates and the like) by washing balls, which are formed of a ceramic material, and washing water without using any detergent and, more particularly, to a washing ball case for a dishwasher, wherein a case body is formed by thermally bonding a top plate and a bottom plate and has through holes formed in an outer side portion thereof so as to completely drain the washing water therethrough at the time of washing dishes such that the washing balls can be maintained in a dried state through the complete drainage of the washing water and the washing efficiency of the washing balls can be maximized in next dish-washing, and, at the time of the thermal bonding, the top plate and the bottom plate can be bonded to each other at uniform positions in a fixed state without movement so as to prevent the conventional bonding defects.

Background Art

In general, a dishwasher is used to wash and clean dishes by using a detergent solution while spraying water after placing the dishes on the racks therein.

Such a dishwasher is divided into a vibration type using ultrasonic waves and a spraying type. In the case of the spraying type, it is positively required to use detergent. Therefore, it is necessary to wash out any remaining detergent from the dishes, increasing the washing time. However, the detergent may still remain on the dishes, resulting in the problems of being harmful to the human body and the like.

In order to solve the above problems, there have been suggested techniques of washing dishes by using washing balls, which are formed of a ceramic material, instead of using detergent. Korean Utility Model No. 20-0458539 and Korean Design Reg. No. 30-633762 disclose such a technique, wherein a case incorporating washing balls therein are set between dishes so as to wash dishes while spraying washing water such that the dishes are washed through the antibacterial and purifying action and the like by the far-infrared radiation from the washing balls, instead of using any detergent.

However, the prior art washing ball case still has problems as follows.

First, the outer side portion of the case is not additionally provided with any holes for drainage such that the washing water stays at the lower portion in the case when the case is set between the dishes during the dish-washing such that the washing balls in the case are wet by the washing water staying in the lower portion.

If the washing balls are wet as above, the washing efficiency of the washing balls for the dish-washing to be carried out later becomes decreased.

That is, the washing balls can exhibit the maximum washing efficiency thereof in a dry and smooth state. However, the washing balls are wet by the washing water staying in the lower portion in the case and thus the washing efficiency thereof becomes inevitably decreased during the dish-washing.

Secondly, when forming the case by the thermal bonding of the top plate and the bottom plate, a hot plate is inserted between the top plate and the bottom plate so as to melt bonding portions thereof and, after removing the hot plate, the top plate and the bottom plate are pressed up and down. Therefore, the top plate and the bottom plate cannot be placed at uniform positions and are not additionally fixed even during the thermal bonding such that the top plate and the bottom plate are likely to move, frequently resulting in the bonding defects of the top plate and the bottom plate.

PRIOR ART DOCUMENT

Patent Document

Patent Document 1 Korean Utility Model No. 20-0458539, Design Reg. No. 30-633762

SUMMARY OF THE INVENTION

Accordingly, the present invention has been made to solve the above-mentioned problems occurring in the prior arts, and it is an objective of the present invention to form a case body for accommodating washing balls by thermally bonding a top plate and a bottom plate, wherein through holes are formed in the outer side portion of the case body so as to maintain the washing balls in a dry state through the complete drainage of the washing water used at the time of washing dishes such that the washing efficiency of the washing balls can be maximized when washing dishes later.

It is another objective of the present invention to bond the top plate and the bottom plate at uniform positions simultaneously with fixing the top plate and the bottom plate without movement by using through holes and reference grooves provided to the outer side portions of the top plate and the bottom plate when forming the case body by thermally bonding the top plate and the bottom plate, thereby preventing the bonding defects resulted in the prior art.

To accomplish the above objectives, according to the present invention, a case body is formed by thermally bonding a top plate and a bottom plate to each other in the vertical direction, which are formed of a synthetic resin material and have holes, and washing balls formed of a ceramic material are accommodated in an internal space part of the case body so as to be used for dish-washing, wherein through holes are formed in an outer side portion of the case body so as to communicate with the internal space part, and vertically positioned at a lower side so as to allow washing water to be completely drained through the through holes at the time of washing dishes.

Further, according to the present invention, through holes are formed in an outer side portion of the case body so as to communicate with the internal space part and correspond to each other in the top plate and the bottom plate, vertically positioned at a lower side so as to allow washing water to be completely drained through the through holes at the time of washing dishes, and inserted by fixing pins of a fixing device such that the top plate and the bottom plate are fixed to be bonded at the time of thermally bonding the top plate and the bottom plate, and reference grooves are formed in the vertical direction on the outer side portion of the case body at the same positions on the top plate and the bottom plate such that thermal bonding positions of the top plate and the bottom plate are uniformly bonded by support bars, which are inserted into the reference grooves during the thermal bonding of the top plate and the bottom plate.

According to the present invention as described above, the case body for accommodating the washing balls is formed by thermally bonding the top plate and the bottom plate, wherein the washing balls can be maintained in a dry state through the complete drainage of the washing water by forming the through holes in the outer side portion of the case body, thereby maximizing the washing efficiency of the washing balls when washing dishes later. Further, when forming the case body by the thermal bonding of the top plate and the bottom plate, it is possible to bond the top plate and the bottom plate at uniform positions while fixing the top plate and the bottom plate without movement by using the through holes and the reference grooves, which are provided to the outer side portions of the top plate and the bottom plate, thereby preventing the bonding defects resulted in the prior art.

BRIEF DESCRIPTION OF THE INVENTION

BRIEF EXPLANATION OF REFERENCE SYMBOLS

Figure 1:
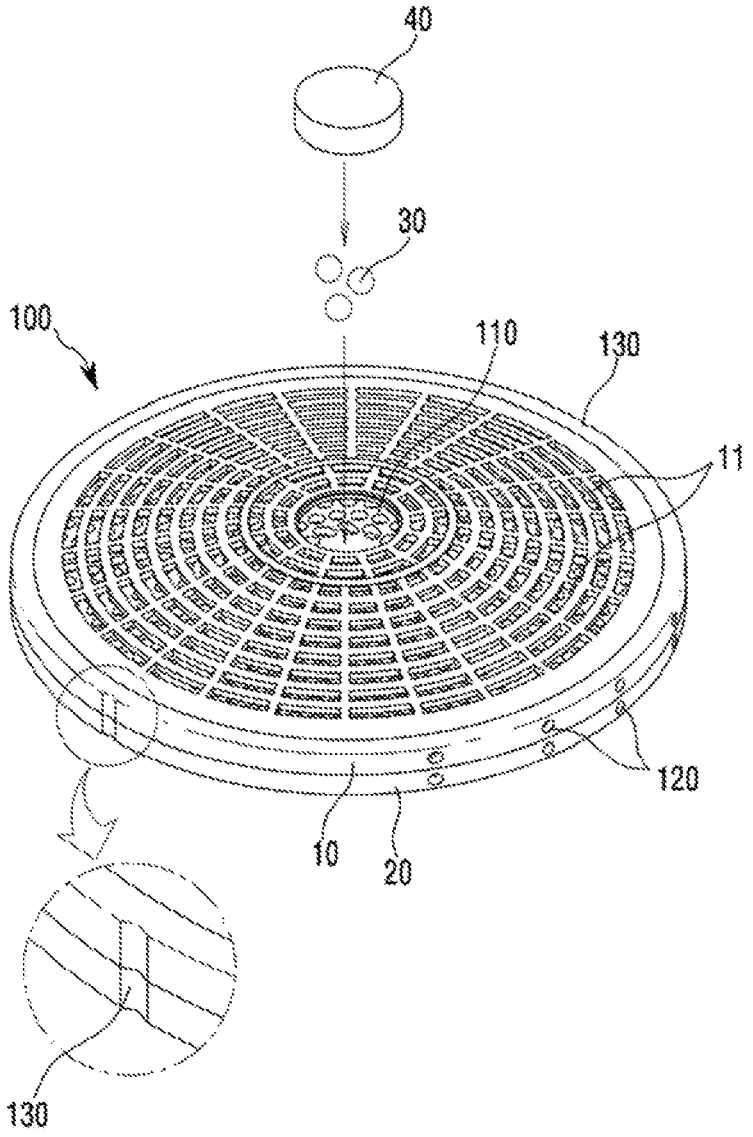
FIG. 1 is an overall perspective view of the present invention.
Figure 2:
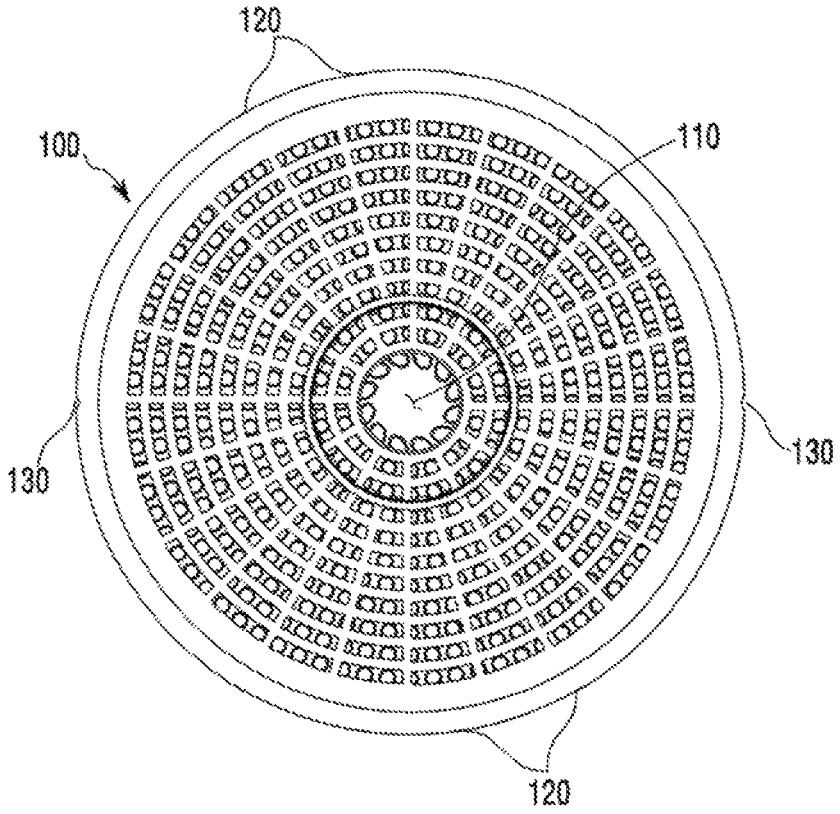
FIG. 2 is a plane view showing the structure of the present invention.
Figure 3:
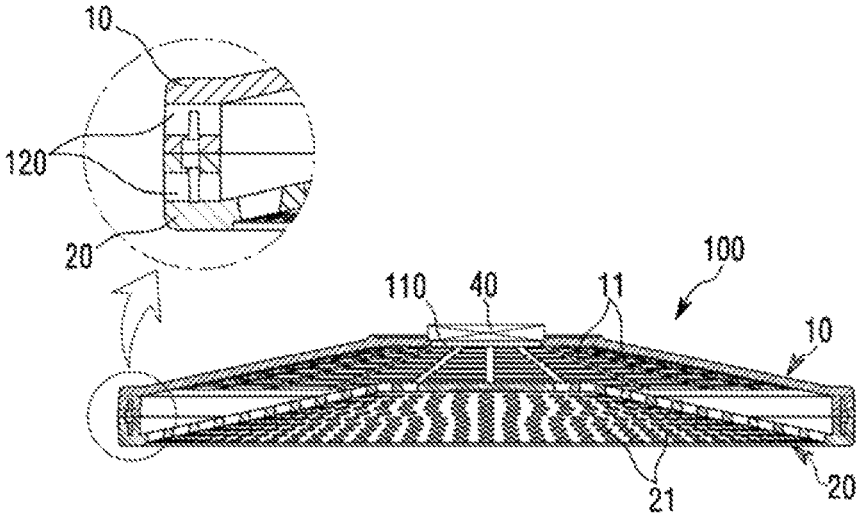
FIG. 3 is a cross-sectional view showing the structure of the present invention.
Figure 4:
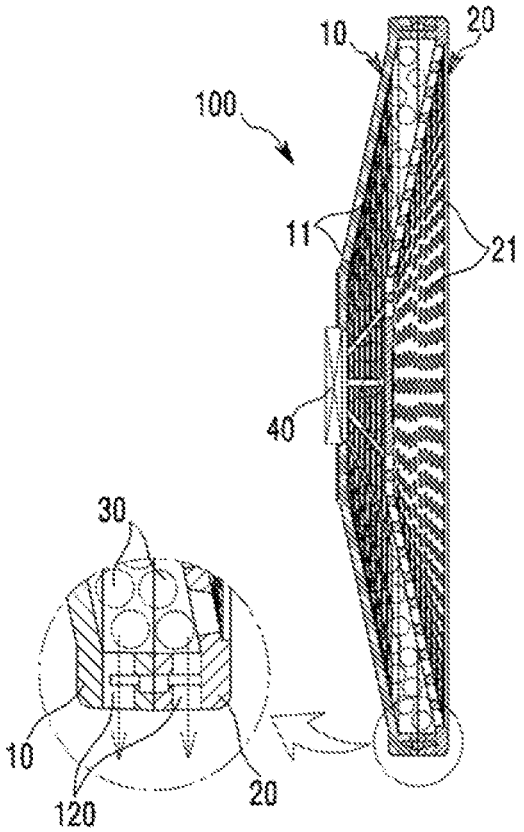
FIG. 4 is a cross-sectional view showing a state, in which the present invention is mounted for washing dishes.
Figure 5:
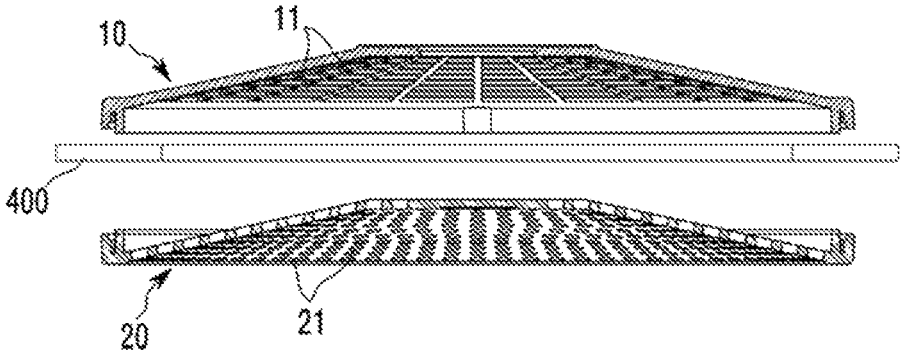
FIG. 5 and FIG. 6 are respectively a side view and a perspective view for showing a thermal bonding process of a top plate and a bottom plate according to the present invention.

| | |
|---|---|
| 10: top plate | 11, 21: holes |
| 20: bottom plate | 30: washing balls |
| 100: case body | 120: through holes |
| 130: reference grooves | 200: fixing device |
| 210: fixing pins | 300: support bars |

DETAILED DESCRIPTION OF THE PREFERRED EMBODIMENT

Hereinafter, reference will be now made in detail to the preferred embodiments of the present invention with reference to the attached drawings.

Referring to FIG. 1 to FIG. 6, a washing ball case for a dishwasher according to the present invention include a case body 100 formed by thermally bonding a top plate 10 and a bottom plate 20 to each other in the vertical direction, which are formed of a synthetic resin material and have holes 11, 21, wherein washing balls 30 formed of a synthetic resin material are accommodated in the internal space part of the case body through a ball insertion hole 110 of the case body so as to be used for washing dishes and the ball insertion hole 110 is closed by a cover 40.

In particular, through holes 120 communicating with the internal space part are formed in the outer side portion of the case body 100 and vertically positioned at the lower part at the time of washing dishes such that washing water is completely drained therethrough.

Herein, it is preferable that the through holes 120 are formed at least at one or more uniform angle positions (at both side positions as shown in the drawings) in the outer side portion of the case body 100.

Further, the through holes 120 formed in the outer side portion of the case body 100 are formed to correspond to each other in the top plate 10 and the bottom plate 20. Therefore, the through holes 120 are used for the drainage of the washing water as described above and also used for the prevention of the movement of the top plate and the bottom plate by inserting fixing pins 210 of a fixing device 200 into the through holes 120 during the thermal bonding of the top plate 10 and the bottom plate 20, thereby preventing bonding defects.

That is, the through holes 120 formed in the outer side portion of the case body 100 are used for both of the function of draining the washing water therethrough in the dishwashing and the function of fixing the top plate and the bottom plate by the fixing pins inserted thereinto in the thermal bonding of the top plate and the bottom plate.

In addition, reference grooves 130 are formed in the vertical direction on the outer side portion of the case body at the same positions of the top plate 10 and the bottom plate 20 and inserted by support bars 300 when thermally bonding the top plate 10 and the bottom plate 20 such that the thermal bonding positions of the top plate and the bottom plate are uniformly maintained, preventing bonding defects.

Herein, it is preferable that the reference grooves 130 are formed in a semi-circular shape, but the reference grooves 130 may be also formed in any other shape. Similarly, even though the case body 100 is shown in a circular shape in the drawings, it is also possible to form the case body 100 in the shape of a square or any other various shape.

Reference sign 400, which is not explained hereinabove, denotes a hot plate.

Hereinafter, the operations of the present invention described as above will be reviewed in detail.

First, the case body 100 is formed by thermally bonding the top plate 10 and the bottom plate 20 to each other in the vertical direction, wherein the top plate 10 and the bottom plate 20 are formed of a synthetic resin material and have holes 11, 21 respectively.

Explaining more specifically, after melting the bonding portions by inserting the hot plate 400 between the top plate 10 and the bottom plate 20, the top plate 10 and the bottom plate 20 are pressed in a state, in which the hot plate is removed, thereby carrying out the thermal bonding.

Herein, the top plate 10 and the bottom plate 20 of the case body 100 are provided with the reference grooves 130 in a semi-circular shape at the same positions in the vertical direction on the outer side portions thereof and the support bars 300 are positioned on the reference grooves 130 such that the top plate 10 and the bottom plate 20 are subject to the thermal bonding in the vertical direction at predetermined positions.

Figure 6:
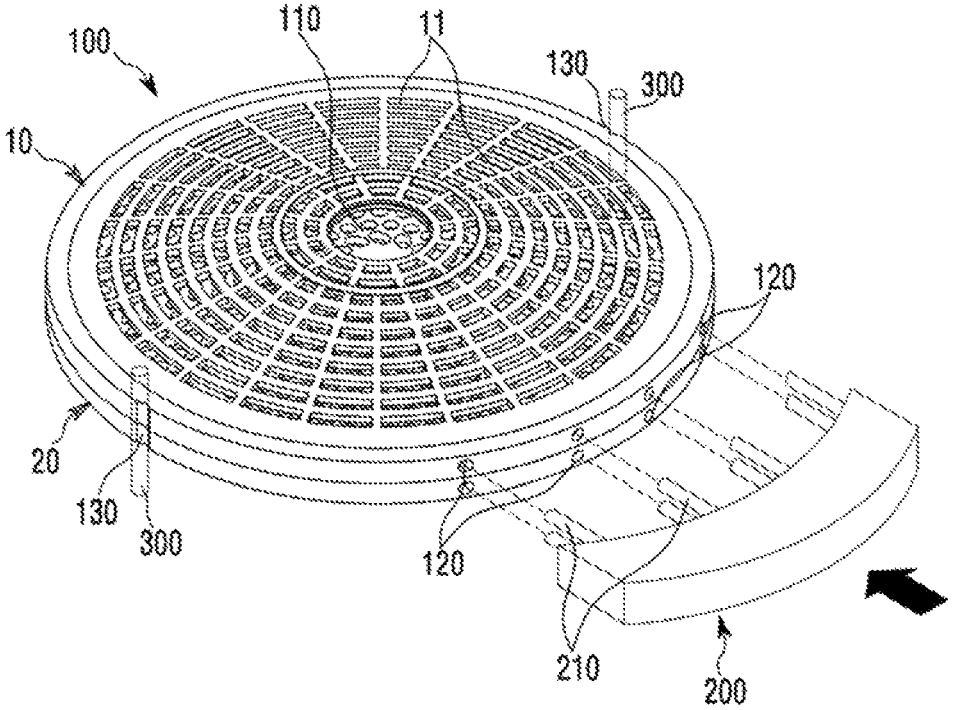

Further, the through holes 120 formed in the outer side portion of the case body 100 are formed to correspond to each other in the top plate 10 and the bottom plate 20. Therefore, when the top plate 10 and the bottom plate 20 are pressed to be molten and bonded to each other, the fixing pins 210 of the fixing device 200 are inserted into the through holes 120 in the outer side portions of the top plate 10 and the bottom plate 20, as shown in FIG. 6, such that the thermal bonding of the top plate 10 and the bottom plate 20 is carried out while fixing the top plate 10 and the bottom plate 20 to prevent any possible movement thereof.

That is, when the case body 100 is formed by the thermal bonding of the top plate 10 and the bottom plate 20, the top plate and the bottom plate are bonded at uniform positions and simultaneously fixed to avoid the movement thereof by using the through holes 120 and the reference grooves 130, which are provided to the outer side portions of the top plate and the bottom plate, thereby preventing the bonding defects resulted in the prior art.

The washing ball case according to the present invention is manufactured as described hereinabove.

The washing ball case manufactured as above is used after the washing balls 30 formed of a ceramic material are inserted into the internal space part through the ball insertion hole 110 of the case body 100 and the ball insertion hole 110 is closed by the cover 40.

That is, the case body 100 is set to stand between dishes in a dishwasher, wherein dish-washing is carried out while spraying washing water in a state, where the case body 100 is set to stand such that the through holes 120 at the outer side portion of the case body are positioned at the lower side thereof.

Herein, dishes can be effectively washed, without using detergent, through the antibacterial and purifying action and the like by the far-infrared radiation from the washing balls 30.

Further, after the dish-washing is finished, the washing water in the case body 100 is completely drained through the through holes 120. Therefore, the washing balls 30 in the case body can be maintained in a dry state such that the washing efficiency of the washing balls can be maximized when washing dishes later.

That is, the washing balls 30 are induced to exhibit the maximum washing efficiency thereof in a dry and smooth state.

What is claimed is:

1. A washing case for use in a dishwasher, comprising:

a convex case body formed of a synthetic resin material having a convex upper plate portion and a convex lower plate portion, a ball insertion hole formed on the convex upper plate portion to accommodate ceramic washing balls and a cover to close the ball insertion hole, wherein the upper plate portion and the lower plate portion respectively have holes thereon, and wherein the upper plate portion and lower plate portion forms an outer shell of the case body;

a first set of through holes formed on an edge of the upper plate portion;

a second set of through holes formed on an edge of the lower plate portion; and wherein the convex upper plate portion and the convex lower plate portion are thermally bonded at their respective edges to form the convex case body, and the first and second set of through holes are formed to communicate with an internal space part of the case body, and vertically positioned at their respective edges so as to allow washing water to be drained at the time of washing.

2. The washing case according to claim 1, wherein the first and second set of through holes are formed at least at one or more uniform angle.

3. The washing case according to claim 1, further comprising:

reference grooves formed in a vertical direction on an edge portion of the case body such that thermal bonding positions of the upper plate portion and lower plate portion are uniformly bonded by support bars, which are inserted into the reference grooves at the time of the thermal bonding of the upper plate portion and the lower plate portion.

4. A washing case for use in a dishwasher, comprising:

a convex case body formed of a synthetic resin material and having a convex upper plate portion and a convex lower plate portion, a ball insertion hole formed on the convex upper plate portion to accommodate ceramic washing balls and a cover to close the ball insertion hole, wherein the upper plate portion and the lower plate portion respectively have holes thereon, and wherein the upper plate portion and lower plate portion form an outer shell of the case body;

a first set of through holes formed on an edge of the upper plate portion;

a second set of through holes formed on an edge of the lower plate portion; and wherein the convex upper plate portion and the convex lower plate portion are thermally bonded at their respective edges to form the convex case body, and the first and second set of through holes are formed to communicate with the internal space part of the case body, and vertically positioned at the edges so as to allow washing water to be drained at the time of washing, and inserted by fixing pins of a fixing device such that the upper plate portion and the lower plate are fixed to be bonded at the time of thermally bonding the upper plate portion and the lower plate portion.

* * * * *